United States Patent [19]

Alm

[11] 4,307,357

[45] Dec. 22, 1981

[54] FORESHORTENED COAXIAL RESONATORS

[75] Inventor: Robert W. Alm, Beaverton, Oreg.

[73] Assignee: Tektronix, Inc., Beaverton, Oreg.

[21] Appl. No.: 127,167

[22] Filed: Mar. 4, 1980

[51] Int. Cl.[3] ..... H01P 1/202; H01P 1/205; H01P 7/04

[52] U.S. Cl. ..... 333/206; 333/207; 333/224

[58] Field of Search ..... 333/202-203, 333/206-212, 222-227, 231-235, 245; 334/40-45, 85

[56] References Cited

U.S. PATENT DOCUMENTS 3,277,406 10/1966 Ocker ..... 333/202

3,348,173 10/1967 Matthaei et al. ..... 333/203

4,037,182 7/1977 Burnett et al. ..... 333/203

4,216,448 8/1980 Kasuga et al. ..... 333/206 X

*Primary Examiner*—Marvin L. Nussbaum

[57] ABSTRACT

A coaxial-structure filter which utilizes a flat depression machined in the bottom surface of the filter cover as the resonant frequency determining element in a resonant cavity is disclosed. The depression is directly above the cavity resonator post when the cover is installed and provides a lumped capacitance from the post to the cover. The resonator post is machined flush with the resonator's top wall thereby placing the critical mechanical dimensions associated with the frequency determining elements in a more desirable location than prior methods (i.e., in the filter cover).

13 Claims, 4 Drawing Figures

FORESHORTENED COAXIAL RESONATORS

BACKGROUND OF THE INVENTION

The present invention relates to coaxial-structure filters and more particularly to the construction of the coaxial resonant cavities contained therein.

This invention is particularly, but not exclusively, useful for the design of microwave filters. The principles disclosed herein, however, may be applied to other microwave devices that employ coaxial resonant cavities.

Several drawbacks are encountered in the course of manufacturing coaxial resonators. Foreshortened coaxial resonators typically incorporate a flat cover and thereby require the resonator posts to be machined below the level of the resonator's outer wall. This is an inconvenient and costly multiple-step machining process.

SUMMARY OF THE INVENTION

According to the present invention a coaxial-structure bandpass filter which utilizes a flat-bottomed depression machined in the bottom surface of the filter cover as the resonant frequency determining element in a resonant cavity is provided. The depression is directly above the cavity resonator post when the cover is installed and provides capacitance from the post of the lid. The capacitance is tuned by means of metallic tuning screws. The resonator post is machined flush with the resonator's top wall in a single machining process.

It is therefore an object of the invention to provide an easily manufacturable coaxial resonant cavity utilizing a foreshortened resonator without actually physically foreshortening the cavity post with respect to the other cavity dimensions.

It is another object of the invention to provide an easily manufacturable coaxial-structure bandpass filter.

BRIEF DESCRIPTION OF THE DRAWINGS

Various features and advantages of the present invention will become apparent upon consideration of the following description, taken in conjunction with the accompanying drawings wherein.

DETAILED DESCRIPTION OF THE PREFERRED EMBODIMENTS

Figure 1:
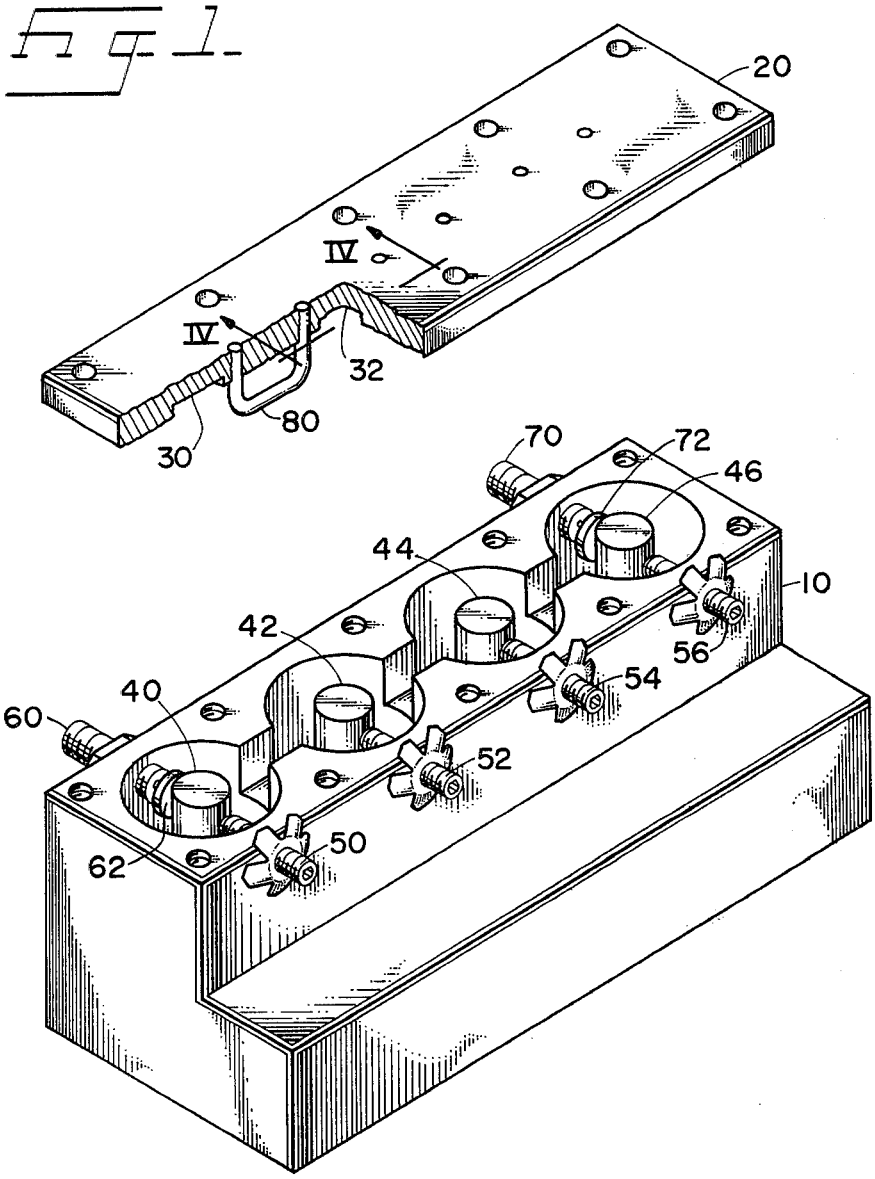
FIG. 1 is an exploded isometric view of the present invention.
Figure 2:
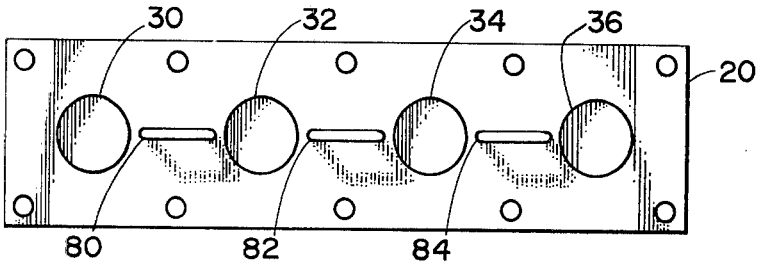
FIG. 2 is a bottom view of filter 20 of FIG. 1.
Figure 3:
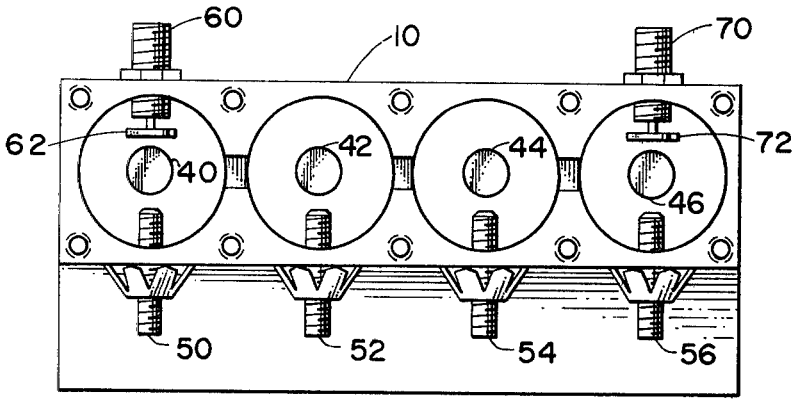
FIG. 3 is a top view of the present invention with filter cover 20 removed.

There are a variety of filters that may be constructed utilizing coupled coaxial resonators. Most of the differences between these filters stem from coupling and construction techniques. This is particularly true at microwave frequencies where distributed resonators predominate.

As is well known in the art, a length of coaxial transmission line behaves as a resonant circuit. It follows that coupled-resonator filters can be constructed from appropriately coupled coaxial transmission lines. It is also known that hollow metal cavities will behave as resonant structures, where the resonant frequency is a function of the cavity dimensions. Coupled-resonator filters can, therefore, be constructed from appropriately coupled resonant cavities.

The exemplary filter shown in the drawing is a coaxial structure band-pass filter intended for purposes of illustration and not for limiting the invention.

A procedure such as that presented in the article "Comb-line Band-pass Filters of Narrow or Moderate Bandwidth", G. L. Matthaei, *The Microwave Journal,* Vol. 6, No. 9 (August 1963), pp. 82–91, may be used to design a coaxial-structure filter. To achieve bandpass filter behavior, the cavity posts are foreshortened to electrical lengths less than a quarter wavelength and resonance is obtained using lumpedcapacitances elsewhere in the resonator. Use of foreshortened resonators results in a filter package that is smaller in one dimension. It is known from the article "Capacity Coupling Shortens Comb-line Filters" E. G. Cristal, *Microwaves,* December, 1967, pp. 44–50, that capacitive coupling at the input and output of the filter further reduces filter size by eliminating the transmission-line matching sections.

A filter such as that described may be realized with rectangular bar resonators according to the data in "Coupled Rectangular Bars Between Plates", W. J. Getsinger, *IRE Transactions on Microwave Theory and Techniques,* Vol. 10 (January 1962), pp. 65–72; or with circular rod resonators according to the data in "Coupled Circular Cylindrical Rods Between Plates", E. G. Cristal, *IEEE Transactions On Microwave Theory And Techniques,* Vol. 12 (July, 1964), pp. 428–439. Virtually any shape cavity and post may be utilized to construct a resonant cavity; e.g., a square cavity and round post or a round cavity and a square post. These various coaxial structures are outlined in *Microwave Transmission Line Data,* M. A. R. Gunston, copyright Marconi Co., Ltd. Various means may be utilized to couple power between adjacent resonant cavities. The commonly used techniques include: loops, probes, and apertures.

The present invention departs from the prior art by providing a unique means of forming the resonant cavities in such a filter. Referring now to the drawing, therein is shown several views of a preferred embodiment of the present invention.

The illustrated filter contains four coupled resonant cavities formed in metallic block 10. RF energy is capacitively coupled to the filter via connector 60 and capacitive probe 62 and then inductively coupled from resonant cavity to resonant cavity by coupling loops 80, 82, and 84. The RF energy exits the filter via capacitive probe 72 and connector 70.

Figure 4:
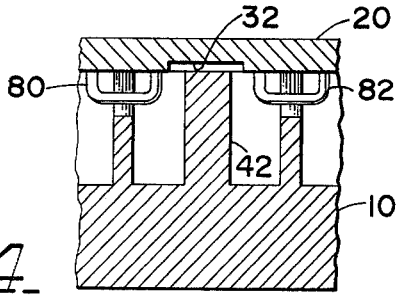
FIG. 4 is a partial cross-sectional view of the present invention showing one of the resonant cavities therein.

Each resonant cavity is comprised of a hollow cylinder and a cylindrical resonator post (40, 42, 44 and 46). The resonator posts are machined flat with the top surface of filter block 10. The required lumped capacitance is provided at the end of each resonator post by a corresponding circular flat-bottomed depression (30, 32, 34, and 36) machined in the bottom surface of filter cover 20 when it is in place as shown in FIG. 4. According to normal practice, a means is provided to tune the lumped capacitance at the open end of each resonator. In the preferred embodiment the tuning means are formed by metallic screws 50, 52, 54, and 56 which are engaged in threaded bores through the side of block 10 in perpendicular alignment with a corresponding one of the resonators.

Coupling loops 80, 82, and 84 are mounted on the bottom surface of filter cover 20. When filter cover 20 is in place loops 80, 82 and 84 extend from cavity to cavity via apertures machined in the adjacent cavity walls. Thus, the RF energy is coupled from cavity to cavity.

In summary, what has been described is a coaxial-structure bandpass filter which utilizes flat-bottomed depressions machined in the bottom surface of the filter cover as the resonant frequency determining elements in a multi-cavity microwave filter. This technique places the critical mechanical dimensions associated with the frequency determining elements in a more desirable location than prior methods.

It may be observed in the foregoing specification that such specification has not been burdened by the inclusion of large amounts of detail and specific information relative to such matters as filter and resonant cavity design and the like. All such information is considered to be within the skill of the art. Examples of publications that relate to such aspects as set forth above are: *Microwave Filters, Impedance-Matching Networks, and Coupling Structures* by G. L. Matthaei, L. Young, and E. M. T. Jones, copyright 1964 by McGraw-Hill; *Principles of Microwave Circuits,* by C. G. Montgomery, R. H. Dickie, E. M. Purcell, copyright 1948 by McGraw-Hill; and *Reference Data For Radio Engineers,* 4th Edition, copyright 1956 by International Telephone and Telegraph Corporation.

It should also be understood that the particular embodiment of the invention which is shown and described herein is intended to be merely illustrative and not restrictive of the invention. Therefore, the appended claims are intended to cover all modifications to the invention which fall within the scope of the foregoing specification.

I claim as my invention:

1. A foreshortened coaxial resonator, comprising:

an electrically conductive body member having at least one cavity formed therein;

at least one resonator means disposed in said cavity of said body member, said resonator means being the same height as the elevation of the wall of said cavity; and cover means having at least one depression formed in the bottom surface thereof said depression being aligned above said resonator when said cover means is placed over said cavity, said depression providing a lumped capacitance at the end of said resonator means.

2. The foreshortened coaxial resonator according to claim 1 wherein said at least one cavity comprises a cylindrical bore.

3. The foreshortened coaxial resonator according to claim 2 wherein said resonator means comprises a cylindrical post.

4. An electrical filter comprising:

an electrically conductive body member having at least one cavity therein;

at least one resonator means disposed in said cavity, said resonator being the same height as the elevation of the wall of said cavity;

detachable cover means having at least one flat-bottomed depression in the bottom surface thereof said depression aligned above said resonator when said cover means is placed over said cavity, said depression providing a lumped capacitance at the end of said resonator means;

input means for applying electrical signals to the electrical filter;

output means for removing electrical signals from said filter; and coupling means for electrically coupling said input means, said resonator means and said output means in series.

5. The electrical filter according to claim 4 wherein said at least one cavity comprises a cylindrical bore.

6. The electrical filter according to claim 5 wherein said at least one resonator means comprises a cylindrical post.

7. The electrical filter according to claim 4 wherein said at least one cavity comprises a plurality of cavities, one resonator is disposed in each cavity and said coupling means comprise magnetic coupling loops for electrically coupling said resonator means in series.

8. The electrical filter according to claim 7 wherein said at least one flat-bottomed depression comprises a plurality of depressions each one thereof aligning with a respective one of said plurality of resonator means when said cover is in place.

9. The electrical filter according to claim 7 wherein said coupling means further comprises capacitive coupling means for coupling electrical signals from said input means to a first one of said plurality of resonator means and capacitive coupling means for coupling electrical signals from a last one of said plurality of resonator means to said output means.

10. The electrical filter according to claim 7 wherein each one of said plurality of cavities includes tuning means for varying the resonant frequency thereof.

11. A foreshortened coaxial resonator, comprising:

an electrically conductive housing including a body member having a cavity opening into a surface thereof, and means secured to said body surface for covering said cavity; and a resonator post disposed within said cavity, one end of said post terminating at the cavity's surface opening, said covering means including means defining a recess opposite said end of the resonator post for providing a lumped capacitance at one end of said resonator.

12. The foreshortened coaxial resonator of claim 11 wherein said covering means is removably secured to said body member.

13. The foreshortened coaxial resonator of claim 11 further comprising:

a plurality of cavity openings in said body member with a resonator post disposed within each of said plurality of cavities and a recess within said covering means opposite each of said resonator post;

capacitive input coupling to said coaxial resonator;

inductive coupling between said cavities of said coaxial resonator; and capacitive output coupling from said resonator.

* * * * *